United States Patent [19]

Talvalkar et al.

[11] Patent Number: 4,628,000

[45] Date of Patent: Dec. 9, 1986

[54] THERMAL TRANSFER FORMULATION AND MEDIUM

[75] Inventors: Shashi G. Talvalkar, Kettering; Thomas P. Besselman, Centerville, both of Ohio

[73] Assignee: NCR Corporation, Dayton, Ohio

[21] Appl. No.: 687,221

[22] Filed: Dec. 28, 1984

[51] Int. Cl.[4] ..... B41M 5/26

[52] U.S. Cl. ..... 428/341; 106/22; 106/23; 106/27; 106/28; 106/29; 106/31; 428/342; 428/484; 428/488.1; 428/913; 428/914; 428/900

[58] Field of Search ..... 106/22, 23, 27–29, 106/31; 428/488.1, 913, 914, 195, 207, 211, 341, 342, 484, 900

[56] References Cited

U.S. PATENT DOCUMENTS

| | | | |
|---|---|---|---|
| 2,352,810 | 9/1985 | Smith | 106/29 |
| 3,519,464 | 7/1970 | Balster et al. | 117/36.1 |
| 3,663,278 | 5/1972 | Blose et al. | 117/234 |
| 3,983,279 | 9/1976 | Matsushita et al. | 428/101 |
| 4,251,276 | 2/1981 | Ferree, Jr. et al. | 106/27 |
| 4,419,024 | 12/1983 | Bowlds et al. | 400/120 |
| 4,421,429 | 12/1983 | Graham | 400/120 |

*Primary Examiner*—Bruce H. Hess

*Attorney, Agent, or Firm*—Wilbert Hawk, Jr.; Albert L. Sessler, Jr.; George J. Muckenthaler

[57] ABSTRACT

A thermal transfer formulation and a thermal transfer medium are disclosed wherein the formulation includes at least a non-crystalline type adhesive-plasticizer or benzoate transfer agent and a coloring material or pigment. The formulation is coated on a substrate to provide means for transferring an image to a receiving substrate.

22 Claims, 2 Drawing Figures

THERMAL TRANSFER FORMULATION AND MEDIUM

BACKGROUND OF THE INVENTION

In the printing field, the impact type printer has been the predominant apparatus for providing increased thruput of printed information. The impact printers have included the dot matrix type wherein individual print wires are driven from a home position to a printing position by individual and separate drivers, and the full character type wherein individual type elements are caused to be driven against a ribbon and paper or like record media adjacent and in contact with a platen.

The typical and well-known arrangement in a printing operation provides for transfer of a portion of the ink from the ribbon to result in a mark or image on the paper. Another arrangement includes the use of carbonless paper wherein the impact from a print wire or a type element causes rupture of encapsulated material for marking the paper. Also known are printing inks which contain magnetic particles wherein certain of the particles are transferred to the record media for encoding characters in manner and fashion so as to be machine-readable in a subsequent operation. One of the known encoding systems is MICR (magnetic ink character recognition) utilizing the manner of operation as just mentioned.

While the impact printing method has dominated the industry, one disadvantage of this type printing is the noise level which is attained during printing operation. Many efforts have been made to reduce the high noise levels by use of sound absorbing or cushioning materials or by isolating the printing apparatus. More recently, the advent of thermal printing which effectively and significantly reduces the noise levels has brought about the requirement for heating of extremely precise areas of the record media by use of relatively high currents. The intense heating of the localized areas causes transfer of ink from a ribbon onto the paper or alternatively, the paper may be of the thermal type which includes materials which are responsive to the generated heat.

Further, it is seen that the use of thermal printing is adaptable for MICR encoding of documents wherein magnetic particles are caused to be transferred onto the documents for machine reading of the characters. The thermal transfer printing approach for use in MICR encoding of documents enables reliability in operation at the lower noise levels.

Representative documentation in the area of transfer material formulations and transfer mediums for use in non-impact printing includes U.S. Pat. No. 3,519,464, issued to L. A. Balster et al. on July 7, 1970, which discloses a heat sensitive element comprising a support paper with a heat sensitive layer of thermoplastic composition and including N-ethyl-p-toluene sulfonamide as a plasticizer for said composition of an organic acid ester, a vinyl acetate polymer, a tackifier, an organic dye, carbon black, and an alkali metal silicate.

U.S. Pat. No. 3,663,278, issued to J. H. Blose et al. on May 16, 1972, discloses a thermal transfer medium having a base with a transferable coating composition of a cellulosic polymer, a thermoplastic resin, a plasticizer, and a sensible dye material.

U.S. Pat. No. 3,983,279, issued to H. Matsushita et al. on Sept. 28, 1976, discloses a multiple heat-sensitive copying medium having a color forming layer, a thermally conductive substrate, and a heat sensitive transfer layer comprising an acid and a phenol, a binder, a solvent and dioctyl phthalate (D.O.P.) plasticizer.

U.S. Pat. No. 4,251,276, issued to W. I. Ferree et al. on Feb. 17, 1981, discloses a transfer ribbon having a substrate coated with a thermally-activated ink composition comprising a thermally-stable polymer, an oil-gelling agent, and an oil dissolving medium or plasticizer such as dipropylene glycol dibenzoate present in a percentage by weight of the total nonvolatile components.

U.S. Pat. No. 4,419,024, issued to P. A. Bowlds et al. on Dec. 6, 1983, discloses a thermal transfer medium which comprises a mixed resistive layer of a thermosetting polyimide, a thermoplastic polyimide, and graphite. The ink formula includes sucrose acetate isobutyrate ethyl cellulose, carbon black, and stearic acid.

And, U.S. Pat. No. 4,421,429, issued to A. E. Graham on Dec. 20, 1983, discloses a thermal transfer medium which comprises a silicon dioxide intermediate layer. The ink formula includes sucrose acetate isobutyrate.

SUMMARY OF THE INVENTION

The present invention relates to non-impact printing. More particularly, the invention provides an ink formulation and a thermal ribbon or transfer medium for use in imaging or encoding characters on paper or like record media documents which enables machine reading of the imaged or magnetic encoded characters. The thermal transfer ribbon enables printing in quiet and efficient manner and the thermal magnetic transfer ribbon makes use of the advantages of thermal printing while encoding documents with a magnetic signal inducible ink.

The ribbon comprises a thin, smooth substrate such as tissue-type paper or polyester-type plastic on which is applied a coating that generally includes a pigment material and a transfer agent dispersed in a diluent of ethyl alcohol or like solvent. The basic coating may include a phthalate material to reduce the transfer temperature and to control the tacky condition of the coated substrate. Another arrangement of the coating includes the transfer agent and a wax mixture applied either as an undercoating or as an overcoating on the substrate. More specifically, the coating includes the use of sucrose benzoate in an adhesive-plasticizer mixture in magnetic and non-magnetic thermal transfer ribbon formulations.

In view of the above discussion, the principal object of the present invention is to provide a ribbon including a thermal transfer coating thereon.

Another object of the present invention is to provide a thermal magnetic transfer ribbon including a coating thereon for use in encoding operations.

An additional object of the present invention is to provide a coating on a ribbon having ingredients in the coating which are responsive to heat for transferring the coating to paper or like record media.

A further object of the present invention is to provide a coating on a ribbon substrate, which coating includes a pigment material and a transfer agent dispersed in a solvent and which is responsive to heat for transferring the coating in precise printing manner onto paper or like record media.

Still another object of the present invention is to provide a thermally-activated coating on a ribbon that is completely transferred from the base of the ribbon onto the paper or document in printing manner at precise positions and during the time when the thermal elements are activated.

Still an additional object of the present invention is to provide Sucrose Benzoate in an adhesive-plasticizer mixture in a thermal transfer coating formulation.

Additional advantages and features of the present invention will become apparent and fully understood from a reading of the following description taken together with the annexed drawing.

DESCRIPTION OF THE PREFERRED EMBODIMENT

Figure 1:
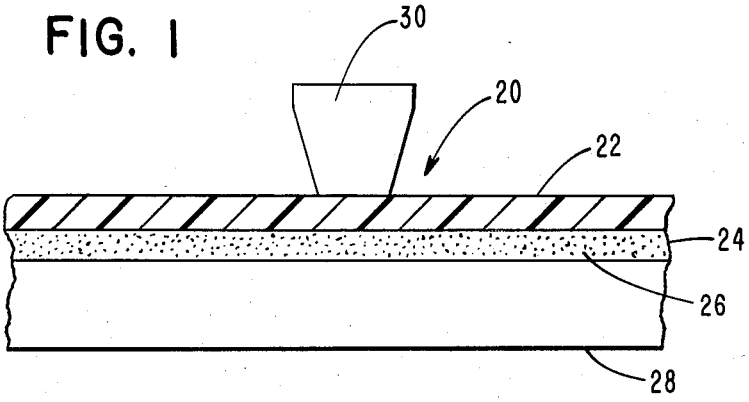
FIG. 1 illustrates a thermal element operating with a ribbon base having a transfer coating thereon incorporating the ingredients as disclosed in the present invention.
Figure 2:
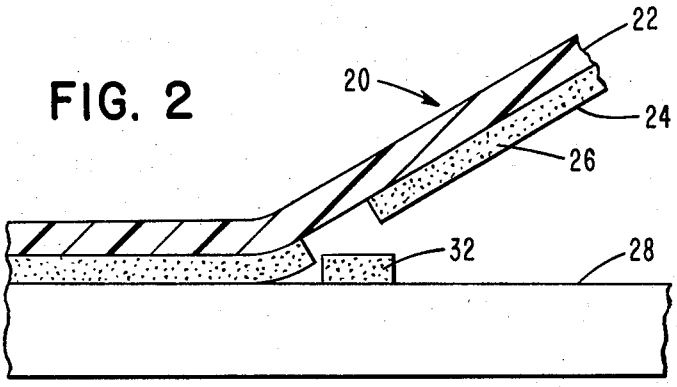
FIG. 2 shows the receiving paper with a coating particle transferred thereto.

The transfer ribbon 20, as illustrated in FIGS. 1 and 2, comprises a base or substrate 22 of thin, smooth tissue-type paper or polyester-type plastic or like material having a coating 24 which is thermally activated and may include magnetic particles 26 as an ingredient therein for use in encoding operations to enable machine reading of characters. Each character that is imaged on a receiving paper 28 or like record media produces a unique magnetic waveform that is recognized and read by the reader. In the case of thermal transfer ribbons relying solely on the thermal printing concept, the magnetic particles 26 are omitted from the coating 24 and may be substituted with conventional coloring materials such as pigments and dyes.

As alluded to above, it is noted that the use of a thermal printer having a print head element, as 30, substantially reduces noise levels in the printing operation and provides reliability in MICR encoding of paper or like documents 28. The thermal magnetic transfer ribbon 20 enables the advantages of thermal printing while encoding the document 28 with a magnetic signal inducible ink. When the heating elements 30 of a thermal print head are activated, the encoding operation requires that the magnetic particles or like material 26 on the coated ribbon 20 be completely transferred from the ribbon to the document 28 in manner and form to produce precisely defined characters 32 for recognition by the reader.

While the magnetic thermal transfer ribbon normally is used in encoding operations and enables machine reading of characters, the thermal transfer ribbon provides for thermal printing on any receiving substrate having a substantially smooth surface.

A basic formulation for the coating to enable transfer of characters in thermal printing operation includes only two required ingredients wherein one of the ingredients is a coloring material or colored pigment and the other ingredient is a transfer agent. The coloring material or colored pigment could be carried with calcium carbonate to provide the required color.

A certain percentage of Di-Octyl-Phthalate (DOP) is added to the basic formulation to reduce the transfer temperature to about 150 degrees F., it being noted that the reduction in temperature is directly proportional to the increased amount of added DOP. However, the increased amount of DOP also increases the tacky condition of the coated sheet which condition is minimized by using pigments such as the calcium carbonate or the carbon black. It is further seen that different coloring materials can be used to obtain coatings of different colors, and also that iron oxide can be substituted for the carbon black to transfer characters which can be read by magnetic reading apparatus.

Having disclosed generally the basic or minimum ingredients which make up the coating of the present invention, the following examples teach specific formulations of the coating. One basic formulation and method of making the coating is in accordance with the following example.

EXAMPLE I

Example I is a composition and method of making a heat sensitive transfer layer or coating 24 for the substrate 22 to a coating weight between 3 and 13 grams per square meter. The basic composition, based on a weight of 100 kilograms of raw coating, includes the following ingredients.

| Material | % Dry | Wet | Range |
|---|---|---|---|
| Sucrose Benzoate | 78.0 | 130.0 | 40–90% |
| Di-Octyl-Phthalate | 15.0 | 15.0 | 5–25% |
| Nigrosine Dye | 7.0 | 7.0 | 2–10% |
| Total | 100.0 | 152.0 | |
| Diluent | | 48.0 | |
| | | 200.0 | |

In the printing operation, the heat causes melting of the Sucrose Benzoate and in combination with any other suitable tackifier effects or imparts an adhering condition thus making the transfer operation complete.

The formulation is prepared by using a 60% solution of the Sucrose Benzoate in the diluent which may be from the group consisting of ethyl alcohol, methyl ethyl ketone (MEK), toluene, or butyl acetate. The Di-Octyl-Phthalate and the Nigrosine Dye are added by stirring the solution to dissolve the dye.

The formulation is coated on capacitor grade tissue or polyester film at the coating weight of 3 to 13 grams per square meter to enable transfer of characters onto a smooth receiving substrate in a clean and smudgeproof manner.

The substrate or base 22, which may be 30 to 50 gauge capacitor tissue, as manufactured by Schweitzer or Tervakoski, USA Inc., or 25 to 50 gauge polyester film, as manufactured by duPont under the trademark Mylar, or as manufactured by ICI or Hoechst of like film, should have an adequate tensile strength to provide for ease in handling and coating of the substrate. Additionally, the substrate should have properties of minimum thickness and low heat resistance to prolong the life of the heating elements 30 of the thermal print head by reason of reduced print head actuating voltage and the resultant reduction in burn time.

The coating 24 is applied to the substrate 22 by means of a Meyer rod or like wire-wound doctor bar or other suitable coating techniques set up on a typical coating machine to provide the coating weight of between 3 and 13 grams per square meter. The coating vessel or apparatus along with the transfer lines and the Meyer rod may be maintained at a required temperature of approximately 50 degrees C. to provide a coating viscosity sufficiently low to enable pumping of the material. The coating is made up of approximately 40 to 50% non-volatile material and may be maintained at the required temperature and viscosity throughout the coating process. After the coating is applied to the substrate, the web of ribbon is passed through a dryer at the elevated temperature in the range between 93 and 150 degrees C. for approximately five to ten seconds to insure good drying and adherence of the coating 24 onto the substrate 22 in making the transfer ribbon 20. The above mentioned coating weight translates to a thickness of five to fifteen microns.

EXAMPLE II

Another example of the use of Sucrose Benzoate in thermal transfer type of coating is described by way of the following formulation.

| Material | % Dry | Wet |
|---|---|---|
| Conventional Flexographic Ink (Typical 40% non-volatile content) | 20.0 | 50.0 |
| Sucrose Benzoate | 60.0 | 60.0 |
| Behenyl Alcohol | 12.5 | 12.5 |
| Santicizer 1-H | 7.5 | 7.5 |
| MEK | | 120.0 |
| Total | 100.0 | 250.0 |

A solution of Sucrose Benzoate, Behenyl Alcohol and Santicizer 1-H is prepared by dispersing these chemicals in MEK under very high agitation. Some heating may be necessary to complete the solution. After the solution is cooled, the flexographic ink is slowly added to the solution and the agitation is continued to assure a complete homogenous mixture. This coating is then applied to the capacitor grade tissue or polyester substrate to a weight of 3 to 13 grams per square meter.

EXAMPLE III

Example III is a composition and method of making a heat sensitive transfer layer or coating for the substrate. The composition, based on a weight of 100 kilograms of raw coating, includes the following ingredients.

| Material | % Dry | Wet | Range |
|---|---|---|---|
| Sucrose Benzoate | 52.8 | 70.4 | 3–80% |
| Di-Octyl-Phthalate | 13.2 | 13.2 | 3–30% |
| Nigrosine Dye | 2.0 | 2.0 | 1–10% |
| Soya Lecithin | 1.2 | 1.2 | 1–3% |
| Calcium Carbonate | 10.6 | 10.6 | 5–20% |
| Carbon Black | 6.0 | 6.0 | 2–10% |
| Carnauba Wax | 4.0 | 4.0 | 2–40% |
| Behenyl Alcohol | 4.0 | 4.0 | 1–30% |
| Butyl Acetate or Toluene or MEK | | 16.6 | |
| Ethyl Alcohol or Isopropyl Alcohol | | 56.5 | |
| Flexographic Ink | 6.2 | 15.5 | 4–20% |
| Total | 100.0 | 200.0 | |

The composition of Example III is formulated by preparing a 75% Sucrose Benzoate solution in Butyl Acetate and DOP by dissolving 60 grams of Sucrose Benzoate in a mixture of 25 grams of Butyl Acetate and 15 grams of DOP. Toluene or MEK can be substituted as a solvent for the Butyl Acetate.

The sucrose benzoate solution is placed into a conventional grinding apparatus such as a ball mill and the rest of the above ingredients are added to the mill and are dispersed or ground for a period of about 20–40 minutes. Water may be circulated in a jacket or like apparatus operably associated with the mill for the 20–40 minute period to maintain the temperature of the mixture at required levels.

The finished composition or coating is then applied to the substrate in the manner as explained above, and wherein the coating weight is controlled between 3 and 13 grams per square meter. The above formulation provides an improved transfer image of characters onto any receiving substrate having a smooth surface.

It is here noted that different color inks, such as Flexo Alcohol Rubine Red, Process Blue, or Yellow can be substituted for the flexographic ink in the formulation. The carbon black is not used and the calcium carbonate or other white pigments are substituted.

EXAMPLE IV

This example is a composition of the heat sensitive transfer layer or coating consisting of two basic mixtures, namely a sucrose benzoate-plasticizer mixture and a wax mixture.

The two mixtures provide a formulation that can be used as an undercoating or as an overcoating for a substrate in producing a thermal transfer ribbon. The following ingredients are used in this formulation.

| Material | % Dry | Wet | Range |
|---|---|---|---|
| Sucrose Benzoate | 17.5 | 17.5 | 3–65% |
| Behenyl Alcohol | 19.3 | 19.3 | 4–35% |
| Melamine Sulfonamide Resin | 17.5 | 17.5 | 0–25% |
| Polyethylene | 23.6 | 23.6 | 0–33% |
| Soya Lecithin | 1.8 | 1.8 | 0–2% |
| Raven Black | 7.9 | 7.9 | 1–20% |
| Di-Octyl-Phthalate | 12.4 | 12.4 | 3–30% |
| Lacolene or Mineral Spirits | | 263.0 | |
| Total | 100.0 | 363.0 | |

The non-volatile materials in the above formulation equate to 27.5%.

EXAMPLE V

An example of the invention used in conjunction with magnetic iron oxide is as follows:

| | % Dry | Wet |
|---|---|---|
| 60% Sucrose Benzoate in Butyl Acetate (Velsicol Chemical) or (Ashland Chemical) | 48.8 | 81.3 |
| Polyethylene/Di-Octyl Phthalate Emulsion (BASF PCZ-900) | 8.4 | 8.4 |
| Carbon Black Dispersion (Alco Black) Borden Chemical) | 7.1 | 16.9 |
| Polyethylene Dispersion (BASF Poly 1005) | 6.7 | 6.7 |
| Dye (Morton Thiokol Inc.) | 2.7 | 5.4 |
| Oxide (Pfizer MO-8029) | 26.3 | 26.3 |
| | 100.0 | 145.0 |
| Ethyl Alcohol (Ashland Chemical) | | 25.0 |
| | | 170.0 |

The non-volatile materials in the above formulation equate to 58.8%.

While the above examples provide the best modes for teaching and carrying out the invention and provide the highest quality print for the utilized technique, there are alternative methods of formulating a thermal transfer ribbon by incorporating portions of each example. One alternate method uses other compatible plasticizers or drying oils for the DOP. Another method uses other waxes for the Behenyl Alcohol.

The availability of the various ingredients used in the present invention is provided by the following list of companies.

| | |
|---|---|
| Di-Octyl-Phthalate | Ashland Chemical Co. |
| Nigrosine Dye | Color Specialties |
| Soya Lecithin | Capricorn Chemical |
| Calcium Carbonate | BASF |
| Carbon Black | Columbian Carbon |
| Carnauba Wax | International Wax |
| Behenyl Alcohol | Fallak Chemical |
| Butyl Acetate or Toluene or MEK | Ashland Chemical |
| Ethyl Alcohol or Isopropyl Alcohol | Ashland Chemical |
| Flexographic Ink | Packaging Corp. |

The above-mentioned different color inks are also available from Packaging Corp.

It should be noted that while the 35 to 50 gauge substrate is about 9–12 microns thick, a substrate thickness of about 9 microns is preferred in the practice of the invention.

It is thus seen that herein shown and described is a formulation and medium for use in thermal printing operations which includes a thermal responsive coating on one surface of the medium. The coated medium enables transfer of coating material onto documents or like record media during the printing operation to form characters thereon in an imaging or in an encoding nature dependent upon non-magnetic or magnetic coating, for use in or permitting human or machine reading, respectively, of the characters. The present invention enables the accomplishment of the objects and advantages mentioned above, and while a preferred embodiment has been disclosed herein, variations thereof may occur to those skilled in the art. It is contemplated that all such variations and modifications not departing from the spirit and scope of the invention hereof are to be construed in accordance with the following claims.

We claim:

1. A thermal-sensitive ink formulation for use in thermal printing comprising a mixture which consists essentially of a sucrose benzoate transfer agent of about 3–65%, a wax of about 3–30%, a resin of about 3–30%, a lecithin of about 1–3%, a dye of about 3–10%, an oil-like material of about 3–30%, all by dry weight, and about 40 to 60% solvent by wet weight for solubilizing the mixture.

2. The formulation of claim 1 wherein the wax is behenyl alcohol.

3. The formulation of claim 1 wherein the resin is melamine sulfonamide.

4. The formulation of claim 1 wherein the lecithin is soya lecithin.

5. The formulation of claim 1 wherein the dye is raven black.

6. The formulation of claim 1 wherein the oil-like material is Di-Octyl-Phthalate.

7. The formulation of claim 1 wherein from about 3–30% polyethylene is present in addition to said wax and said resin.

8. A thermal-sensitive ink formulation comprising a coloring material of about 5–15% and a sucrose benzoate transfer agent of about 40–90% by dry weight, and about 40–60% solvent by wet weight for solubilizing the mixture.

9. The ink formulation of claim 8 wherein the coloring material is nigrosine dye.

10. The ink formulation of claim 8 including an oil-like material of about 5–25% by dry weight for reducing the temperature of transferring the ink formulation.

11. The ink formulation of claim 10 wherein the oil-like material is dioctylphthalate.

12. The ink formulation of claim 8 wherein the coloring material is carried by calcium carbonate.

13. The ink formulation of claim 8 wherein the coloring material is carbon black.

14. A ribbon for use in non-impact printing comprising a substrate and a transfer layer which is a mixture containing about 3 to 80% sucrose benzoate transfer agent, about 3 to 30% drying oil, about 1 to 10% dye, about 1 to 3% lecithin, about 5 to 20% coloring pigment, about 2 to 40% wax, all by dry weight, and about 40 to 60% solvent by wet weight for solubilizing the mixture.

15. The ribbon of claim 14 wherein the transfer layer consists of a coating weight about 4.5 to 12.5 grams per square meter.

16. The ribbon of claim 14 wherein the coloring pigment is carried by calcium carbonate.

17. The ribbon of claim 14 wherein the coloring pigment is carbon black.

18. The ribbon of claim 14 wherein the mixture contains about 2 to 10% magnetic metal on an oxide thereof.

19. The ribbon of claim 14 wherein the drying oil is di-octyl-phthalate.

20. The ribbon of claim 14 wherein the dye is nigrosine dye.

21. The ribbon of claim 14 wherein the lecithin is soya lecithin.

22. The ribbon of claim 14 wherein the wax is behenyl alcohol.

* * * * *